US010355405B2

(12) United States Patent
Sone

(10) Patent No.: US 10,355,405 B2
(45) Date of Patent: Jul. 16, 2019

(54) DEVICE CONNECTOR AND CONNECTOR STRUCTURE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventor: Kosuke Sone, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/960,814

(22) Filed: Apr. 24, 2018

(65) Prior Publication Data

US 2018/0316129 A1 Nov. 1, 2018

(30) Foreign Application Priority Data

Apr. 28, 2017 (JP) ..... 2017-089304

(51) Int. Cl.

| | |
|---|---|
| ***H01R 13/04*** | (2006.01) |
| ***H01R 13/50*** | (2006.01) |
| ***H01R 103/00*** | (2006.01) |
| ***H01R 13/627*** | (2006.01) |
| ***H01R 13/629*** | (2006.01) |
| ***H01R 13/631*** | (2006.01) |

(52) U.S. Cl.

CPC ..... *H01R 13/6272* (2013.01); *H01R 13/50* (2013.01); *H01R 13/629* (2013.01); *H01R 13/04* (2013.01); *H01R 13/631* (2013.01); *H01R 2103/00* (2013.01)

(58) Field of Classification Search

CPC ..... H01R 13/6272; H01R 13/44
USPC ..... 439/345
See application file for complete search history.

(56) References Cited

U.S. PATENT DOCUMENTS

| | | | | |
|---|---|---|---|---|
| 5,338,211 A * | 8/1994 | Kodama | ..... | H01R 13/639 439/135 |
| 6,171,125 B1 * | 1/2001 | Kirkendall | ..... | H01R 13/64 439/218 |
| 2015/0147904 A1 * | 5/2015 | Takahashi | ..... | H01R 13/53 439/380 |
| 2016/0149333 A1 * | 5/2016 | Yoshigi | ..... | H01R 13/516 439/660 |
| 2016/0190755 A1 * | 6/2016 | Kitamura | ..... | H01R 13/506 439/11 |

(Continued)

FOREIGN PATENT DOCUMENTS

| | | | | |
|---|---|---|---|---|
| JP | 2014-11092 | 1/2014 | | |
| JP | 2015035389 A * | 2/2015 | ..... | H01R 24/20 |

*Primary Examiner* — Abdullah A Riyami
*Assistant Examiner* — Nader J Alhawamdeh
(74) *Attorney, Agent, or Firm* — Gerald E. Hespos; Michael J. Porco; Matthew T. Hespos

(57) ABSTRACT

A device-side connector (10) includes a plurality of male terminals (11) and a locking portion (13) for locking a mating connector. The male terminals (11) and the locking portion (13) are disposed on a peripheral surface of a device having a hollow cylindrical shape. The locking portion (13) is disposed side by side with the plurality of male terminals (11) on an outer peripheral surface of the device.

3 Claims, 7 Drawing Sheets

(56) References Cited

U.S. PATENT DOCUMENTS

2016/0197438 A1* 7/2016 Kitamura ..... H01R 13/631
439/376
2016/0197461 A1* 7/2016 Kitamura ..... H01R 24/20
174/72 A

* cited by examiner

DEVICE CONNECTOR AND CONNECTOR STRUCTURE

BACKGROUND

Field of the Invention

The invention relates to a device connector and a connector structure to be attached to a device that has a hollow cylindrical shape.

Description of the Related Art

Japanese Unexamined Patent Publication No. 2014-11092 discloses a connector structure configured to connect a device and a wire for transmitting power, a control signal or the like to the device. The device may be a hydraulic control device and may be used in lubricant (ATF) in an automatic transmission.

The connector has a housing with terminal accommodation chambers that have open front ends. Each terminal accommodation chamber further has terminal holding surfaces in a backmost part of the connector housing and shifting a left half and a right half in a front-rear direction. Base end parts of the respective terminals extending from this terminal holding surface are exposed in the lubricant but are separated in the front-rear direction. In this way, even if an external matter enters between the respective base end parts, a short circuit caused by the contact of that external matter with the both base end parts is prevented.

However, the shifting of the terminals in the front-rear direction enlarges the connector in the front-rear direction. In addition, a locking structure to a mating connector must be provided in an uppermost part of the connector to carry out an unlocking operation. This locking structure must be provided above the terminals despite a demand for height reduction.

The invention was completed on the basis of the above situation and aims to reduce a height while reliably preventing a short circuit caused by external matter in a device connector or a connector structure to be attached to a device having a hollow cylindrical shape.

SUMMARY

A device connector disclosed in this specification includes terminals and a locking portion for locking a mating connector. The terminals and the locking portion are disposed side-by-side on an outer peripheral or circumferential surface of a device having a hollow cylindrical shape. According to this configuration, a height can be reduced as compared to the case where the locking portion is provided above the terminals.

The locking portion may be formed of insulating synthetic resin and may be disposed between the terminals. The disposition of the insulating locking portion between the terminals reliably prevents a short circuit and efficiently uses a clearance between the terminals.

The terminals may be male terminals formed of metal pieces and having a tongue shape. Plate surfaces of the terminals may be disposed along a radial direction of the device. According to this configuration, connection spaces for the male terminals and female terminals of the mating connector may be provided in a circumferential direction of the device, thereby further reducing a height of the connector.

The connector structure may comprise a first connector including male terminals and a second connector including female terminals. The first and second connectors are connectable. The connector structure is mounted on an outer peripheral surface of a device having a hollow cylindrical shape. The connector structure includes terminal holding structures for holding the male terminals and the female terminals and a locking structure for maintaining a connected state of the first connector and the second connector. The locking structure may be disposed between two of the terminal holding structures and may be disposed side by side with the terminal holding structures on the outer peripheral surface of the device.

Accordingly, it is possible to reduce a height while reliably preventing a short circuit caused by external matter in a device connector or a connector structure to be attached to a device having a hollow cylindrical shape.

DETAILED DESCRIPTION

An embodiment of the invention is described with reference to FIGS. 1 to 7. Note that, in the following description, an X direction is a forward direction, a Z direction is an upward direction and an R direction is a circumferential direction of a solenoid D to be described later. Further, in the following description, only one member may be denoted by a reference sign without other identical members being denoted by a reference sign.

A connector structure 1 is a solenoid connector configured to connect the cylindrical solenoid D and a wire for transmitting power, a control signal or the like by being attached to these and used in lubricant (ATF) in an automatic transmission.

Figure 1:
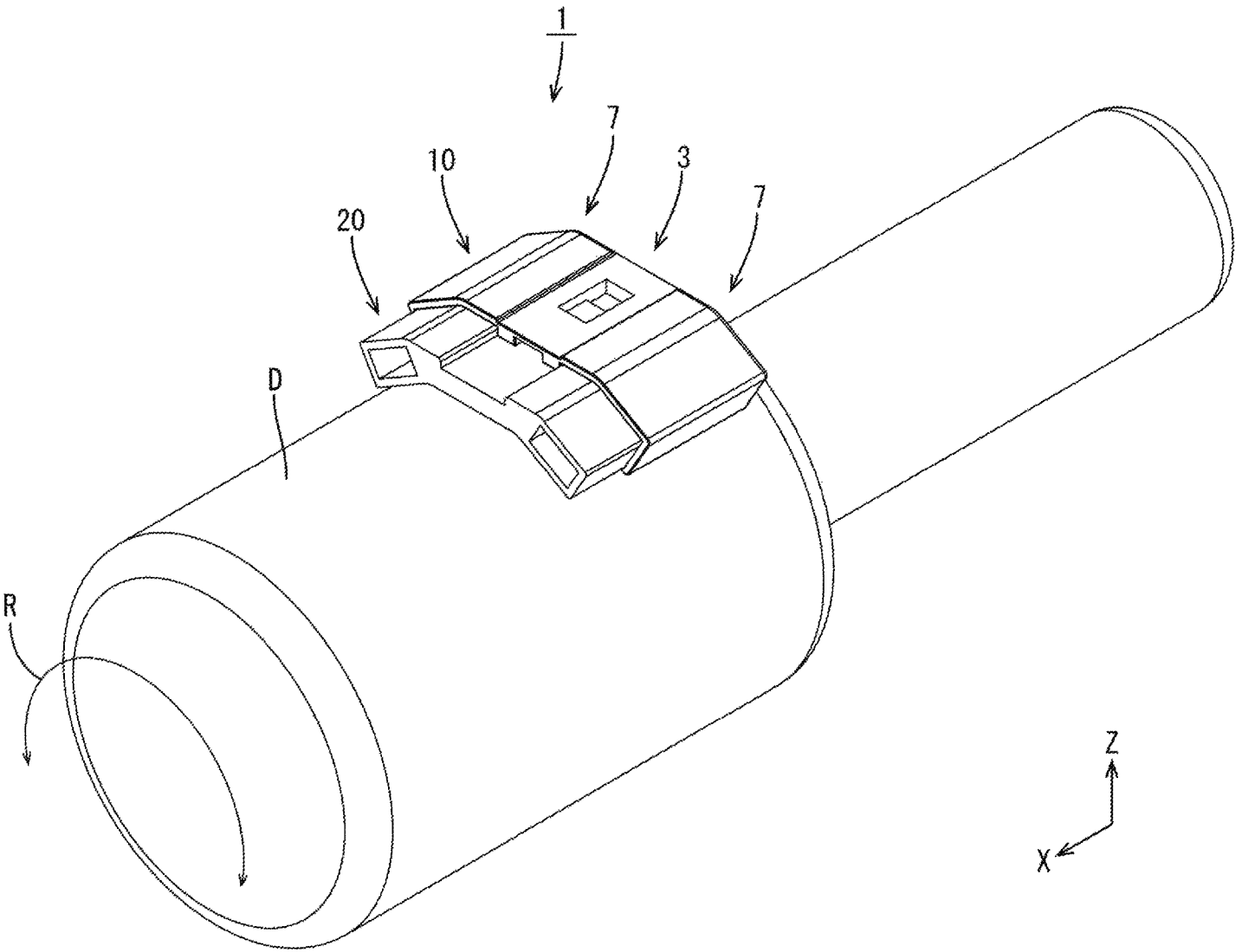
FIG. 1 is a perspective view showing a connector structure of an embodiment.
Figure 2:
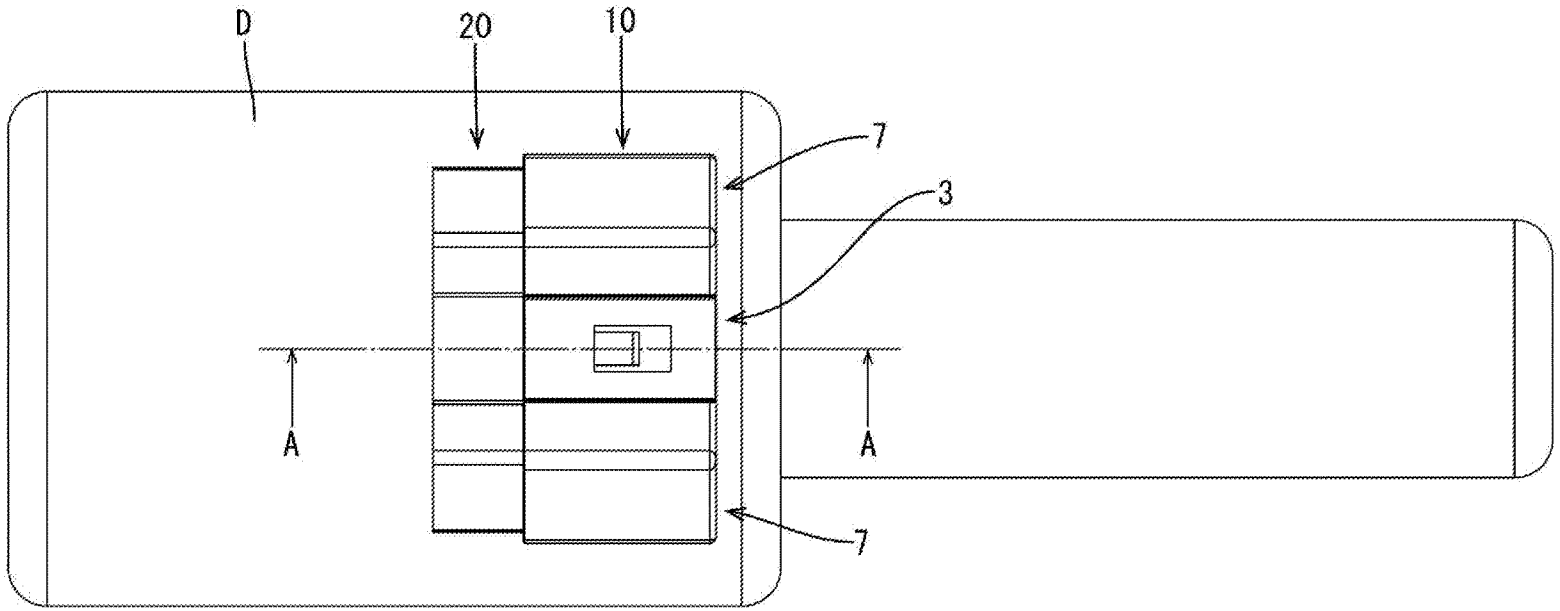
FIG. 2 is a top view showing the connector structure.

As shown in FIG. 1, the connector structure 1 includes a device-side connector 10 (example of a first connector) to be attached to the solenoid D and a wire-side connector 20 (example of a mating connector or second connector) to be attached to an end of the wire and disposed to be fit into the device-side connector 10. The device-side connector 10 has a flat and substantially arcuate shape extending along the outer peripheral surface of the solenoid D. Note that since the wire to which the wire-side connector 20 is to be attached is known and an attachment structure thereof can be selected arbitrarily, the wire is neither described nor shown.

Figure 3:
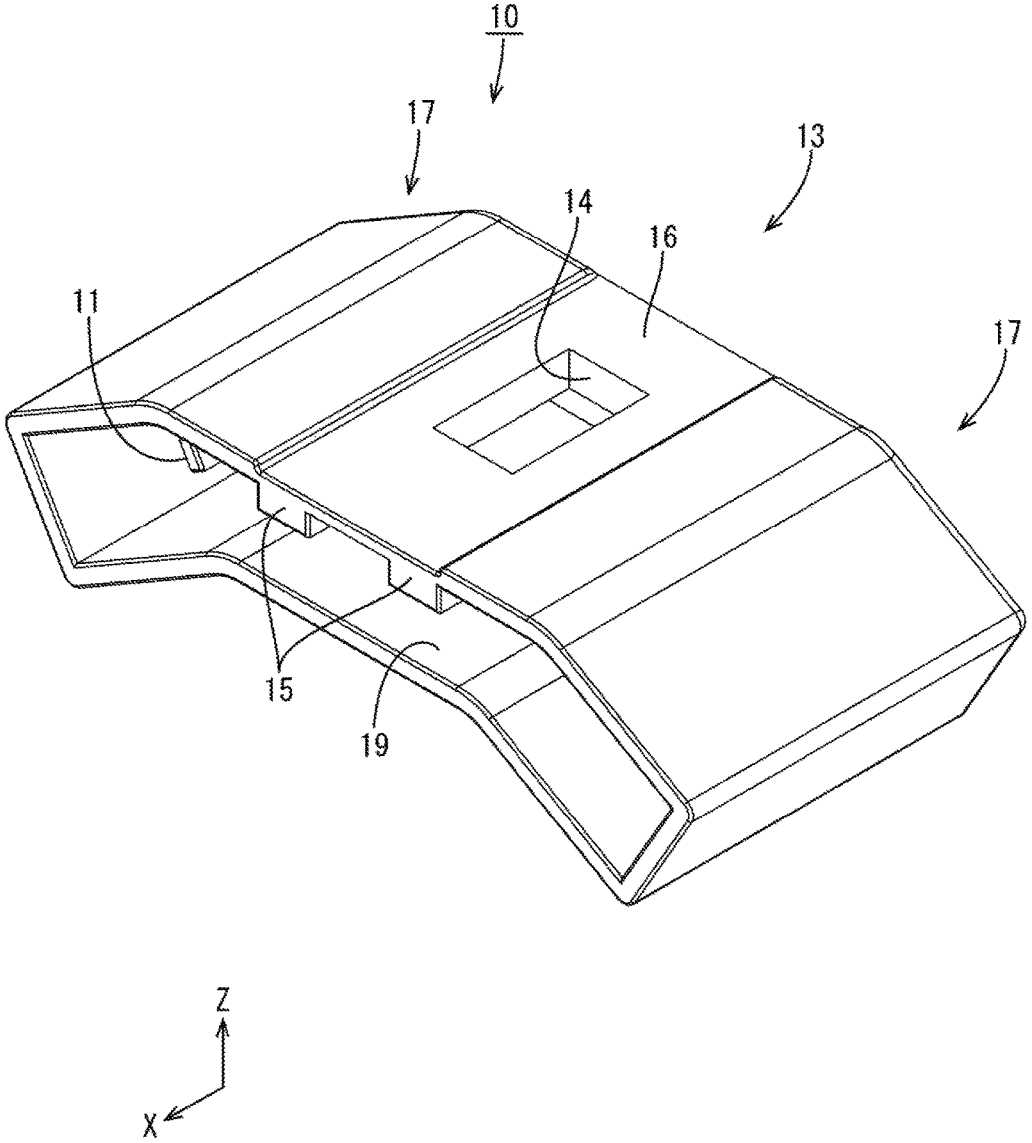
FIG. 3 is a perspective view showing a device-side connector.

The device-side connector 10 is a hollow body formed of insulating synthetic resin, having a substantially arcuate shape, vertically flat and having an open front surface, as shown in FIG. 3. The device-side connector 10 is formed with first terminal holding portions 17 on both left and right sides in the circumferential direction of the solenoid D, and a male terminal 11 is disposed in each first terminal holding portion 17. A first locking portion 13 is provided between the first terminal holding portions 17.

Figure 4:
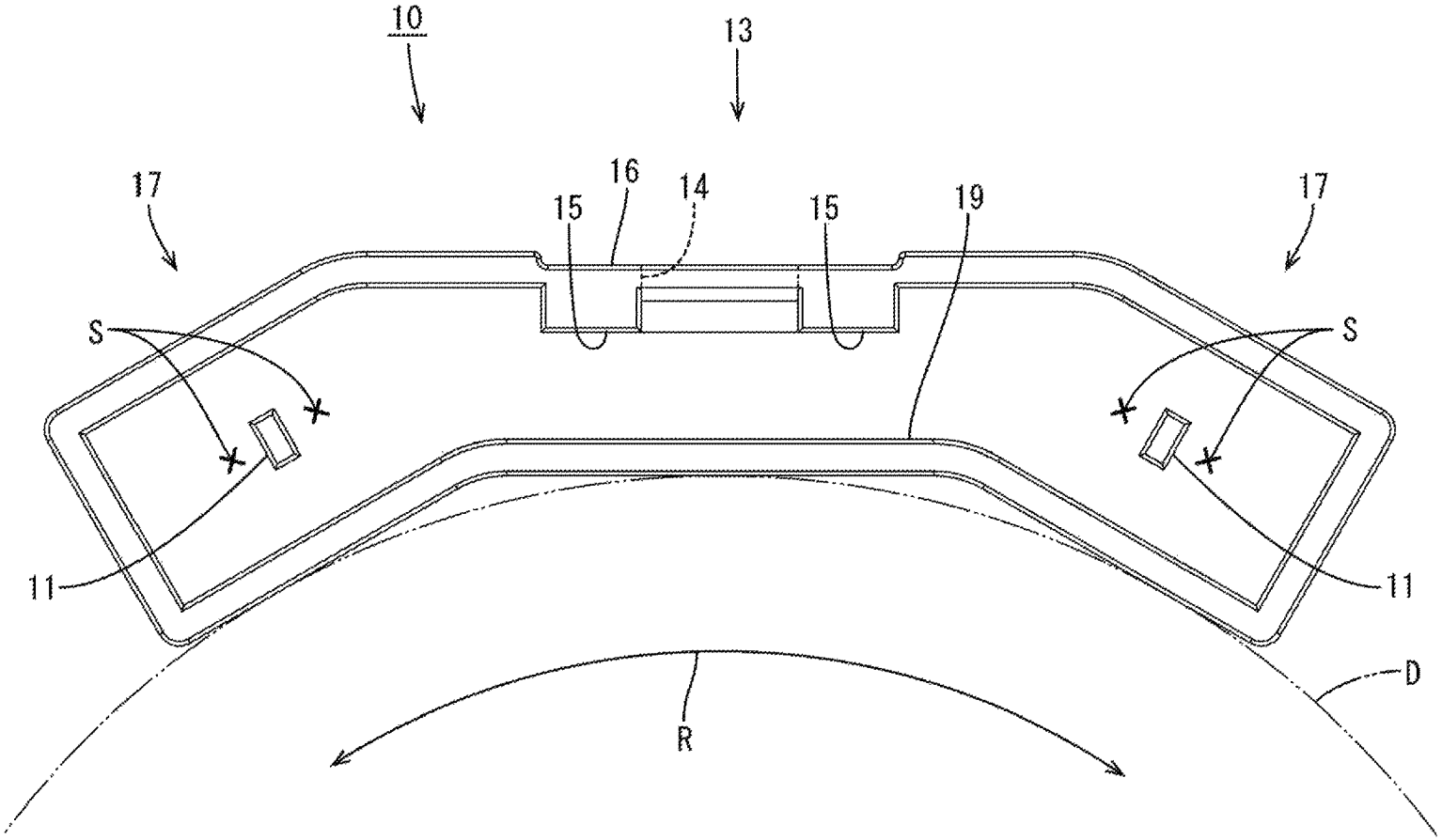
FIG. 4 is a front view showing the device-side connector.

The male terminal 11 is a metal piece having a tongue shape and is formed, such as by stamping a metal plate, to extend forward from a substantially center of the back surface of each first terminal holding portion 17, as shown in FIG. 4. Each male terminal 11 is disposed with plate surfaces thereof extending along a radial direction of the solenoid D, and arrangement spaces S for female terminals 21 are provided at both sides of the male terminal 11.

The first locking portion 13 is formed from insulating synthetic resin and is integral with the device-side connector 10. The first locking portion 13 includes a ceiling plate 16 having a substantially flat upper surface, a bottom surface 19 facing the ceiling plate 16, a locking hole 14 to be locked to the wire-side connector 20 and two ridges 15 for suppressing a lateral displacement of the wire-side connector 20. The locking hole 14 penetrates through a central part of the ceiling plate 16 near a rear end and has a rectangular shape. The ridges 15 are provided on the lower surface of the ceiling plate 16, and project from the front end to the rear end of the ceiling plate 16 on both sides across the locking hole 14. Note that a height of the first locking portion 13 in the radial direction of the solenoid D is smaller than those of the first terminal holding portions 17.

Figure 5:
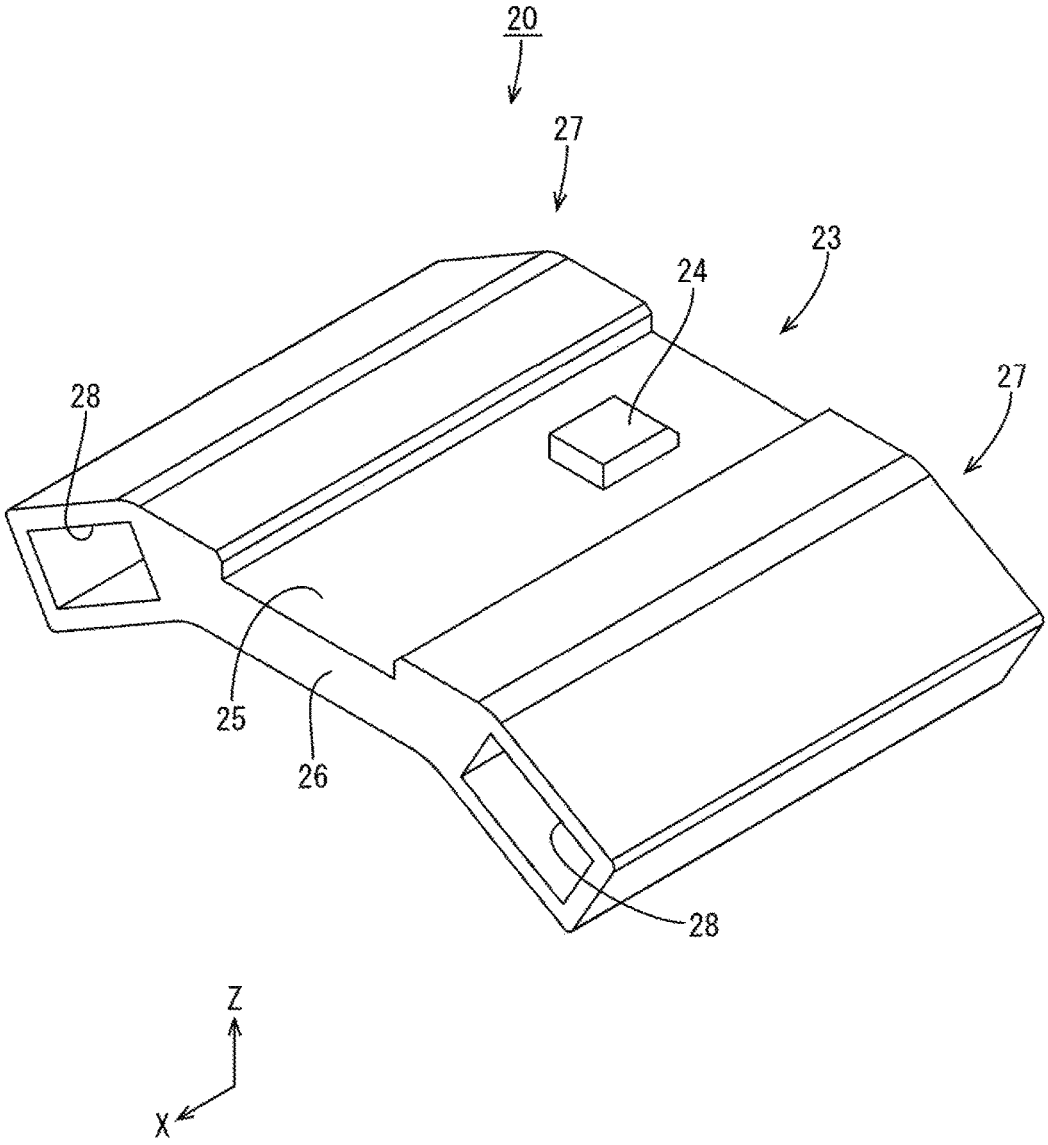
FIG. 5 is a perspective view showing a wire-side connector.

The wire-side connector 20 is formed of insulating synthetic resin and has a vertically flat and substantially arcuate shape corresponding to an inner space of the device-side connector 10, as shown in FIG. 5. The wire-side connector 20 is provided with second terminal holding portions 27 on both left and right sides in the circumferential direction of the solenoid D. The female terminals 21 are disposed in the second terminal holding portions 27 and a second locking portion 23 is provided between the second terminal holding portions 27.

A terminal engaging hole 28 penetrates through each second terminal holding portion 27 in the front-rear direction. The female terminal 21 is disposed in this terminal engaging hole 28. The female terminals 21 are not shown but have a known structure with metal pieces in the form of a resiliently deformable spring. These two metal pieces are disposed laterally side by side in the circumferential direction of the solenoid D so that each spring piece is laterally resiliently deformable inside each terminal engaging hole 28.

The second locking portion 23 is formed from insulating synthetic resin and is integral to the wire-side connector 20. The second locking portion 23 includes a locking body 26, a groove 25 and a locking projection 24. The locking body 26 is a substantially flat plate having a smaller height in the radial direction of the solenoid than each second terminal holding portion 27. The groove 25 is recessed in the upper surface of the locking body 26 from a front end to a rear end and has a flat bottom surface. The locking projection 24 projects in a central part of the groove 25 near a rear end and has a flat and substantially rectangular parallelepiped shape.

By the above configuration, two terminal holding structures 7 are configured from the two first terminal holding portions 17 provided in the device-side connector 10 and the second terminal holding portions 27 provided in the wire-side connector 20 to correspond to the respective first terminal holding portions 17. A locking structure 3 is configured from the first locking portion 13 provided in the device-side connector 10 and the second locking portion 23 provided in the wire-side connector 20. The connector structure 1 includes the terminal holding structures 7 and locking structure 3 and is configured by disposing the locking structure 3 between the two terminal holding structures 7 on the outer peripheral surface of the solenoid D.

Figure 6:
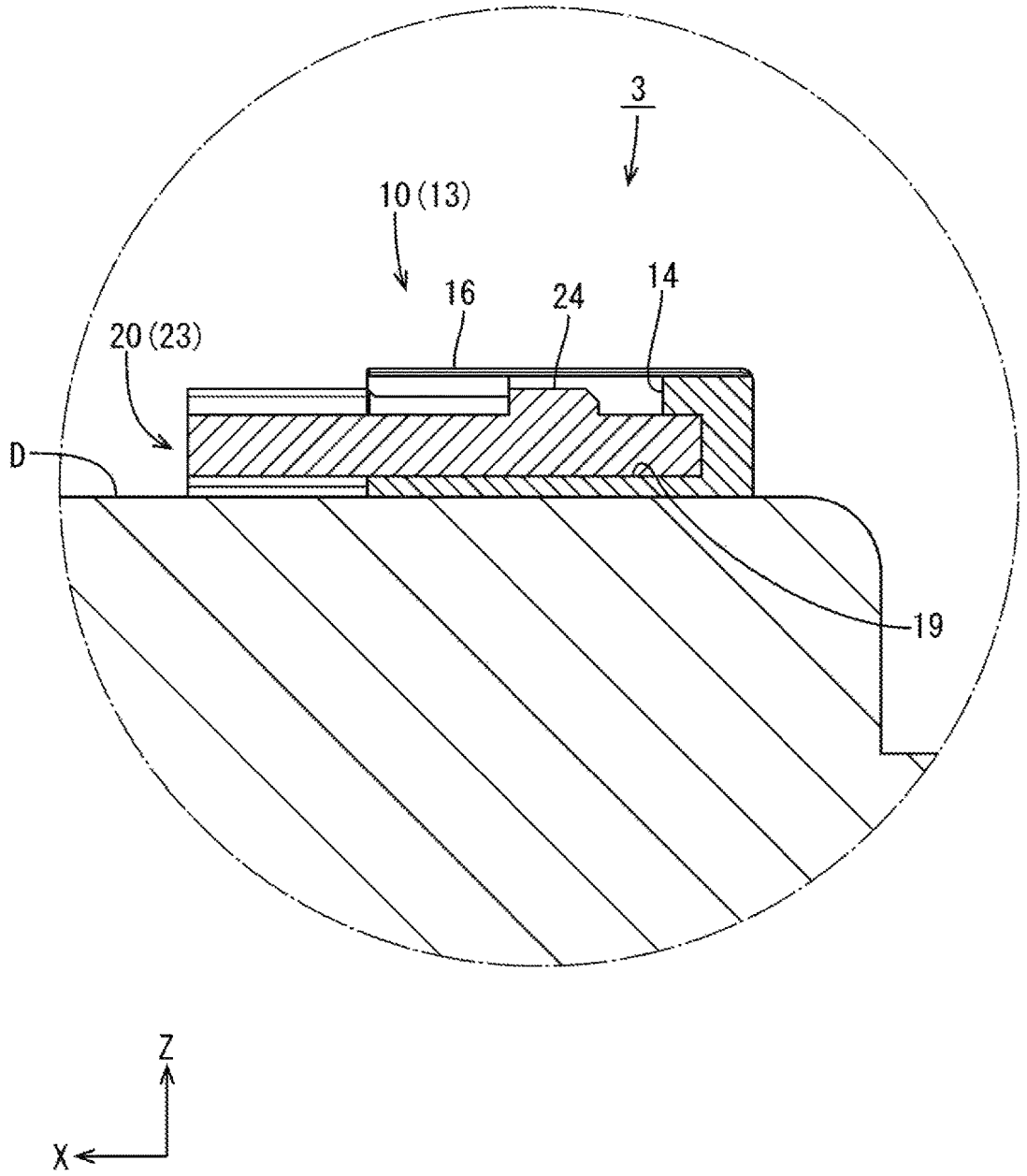
FIG. 6 is a section along A-A of FIG. 2.
Figure 7:
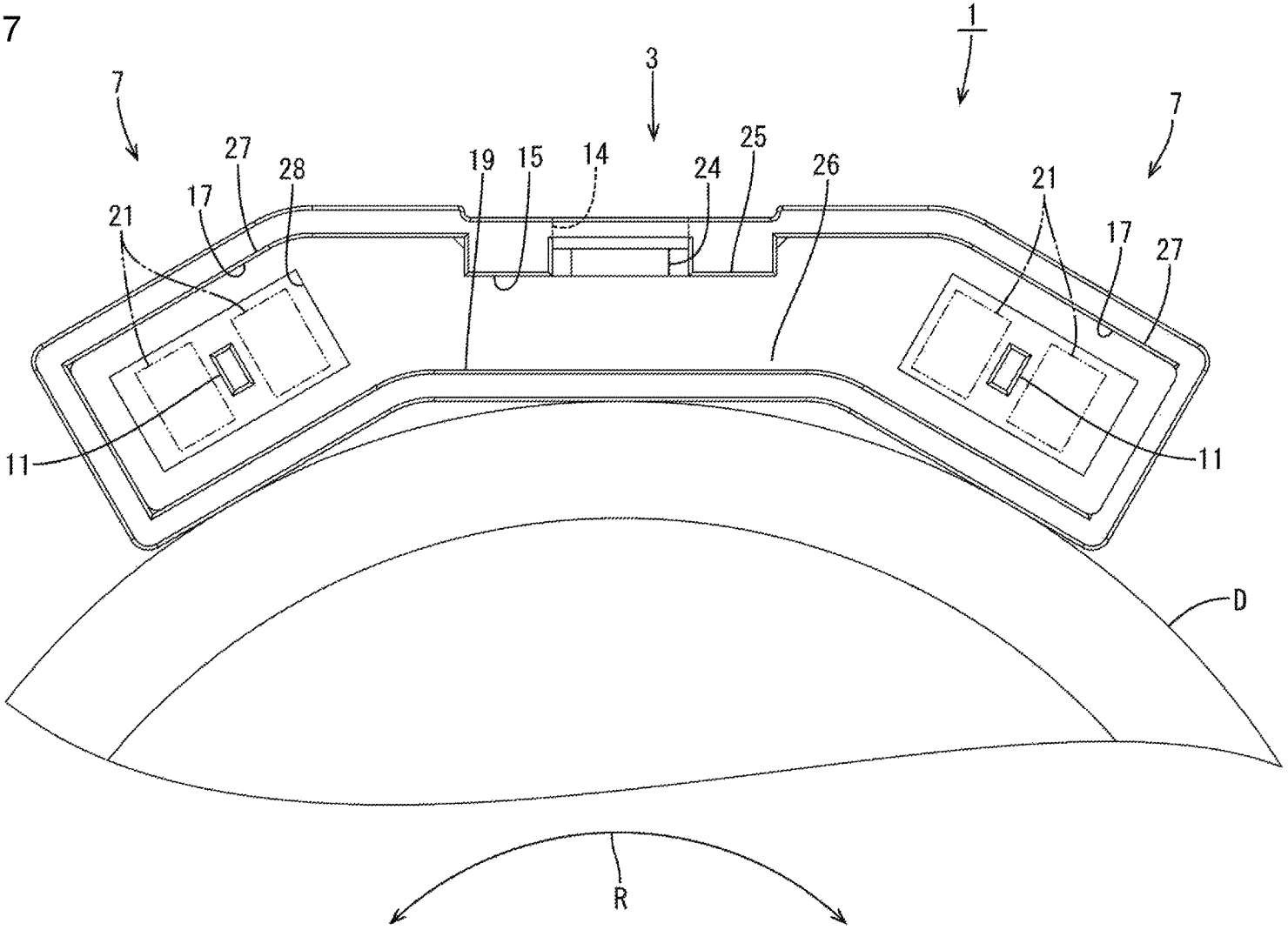
FIG. 7 is a front view showing the connector structure.

When the wire-side connector 20 is connected to the device-side connector 10, the groove 25 is meshed with the ridges 15 from the front, and the locking body 26 is inserted rearward with the lower surface thereof sliding along the bottom surface 19 and is arranged in a locking receiving space of the device-side connector 10. Then, each second terminal holding portion 27 is fit into each first terminal holding portion 17, and each female terminal 21 clamps each male terminal 11 in the terminal engaging hole 28 to be connected electrically to each male terminal 11. Further, as shown in FIG. 6, the locking projection 24 of the wire-side connector 20 resiliently returns and is fit into the locking hole 14 so that the wire-side connector 20 is locked to the device-side connector 10. Note that, in this state, a top part of the locking projection 24 is below the upper surface of the ceiling plate 16 of the device-side connector 10 (first locking portion 13), so that the second locking portion 23 is accommodated entirely in the first locking portion 13 of the device-side connector 10. Further, the first locking portion 13 is disposed side by side with the two male terminals 11 on the outer peripheral surface of the solenoid D and disposed between the two male terminals 11.

According to the above configuration, the first locking portion 13 for maintaining a connected state of the device-side connector 10 and the wire-side connector 20 is disposed side by side with each male terminal 11 on the outer peripheral surface of the solenoid D. Thus, the height of the device-side connector 10 and the connector structure 1 can be reduced as compared to the case where the first locking portion 13 is above the first terminal holding portions 17.

Further, the male terminals 11 are separated by at least a lateral dimension of the first locking portion 13. Thus, even if external matter enters between the male terminals 11, a short circuit caused by contact of the external matter with both male terminals 11 can be prevented.

Further, the male terminals 11 are disposed with the plate surfaces extending along the radial direction of the solenoid D and the arrangement spaces S for arranging the female terminals 21 are provided at left and right sides in the circumferential direction of the solenoid of the male terminals 11. Thus, the device-side connector 10 and the connector structure 1 can be reduced in height as compared to a configuration where the male terminals 11 have plate surfaces extending along the circumferential direction of the solenoid D and the female terminals 21 clamp the male terminals 11 from upper and lower sides in the radial direction of the solenoid.

Further, the second locking portion 23 made of insulating synthetic resin is disposed between the second terminal holding portions 27 having the female terminals 21 provided therein in the wire-side connector 20. Thus, the female terminals 21 reliably are insulated from each other. Furthermore, with the wire-side connector 20 fit in the device-side connector 10, parts of the male terminals 11 accommodated in the terminal engaging holes 28 of the second terminal holding portions 27 also are insulated reliably The invention is not limited to the above described and illustrated embodiment. For example, the following embodiments are possible.

The locking structure 3 is disposed between the two terminal holding structures 7 in the circumferential direction of the solenoid D in the above embodiment. However, two terminal holding structures may be disposed side by side in the circumferential direction of the solenoid D at one side of a locking structure.

Although two terminal holding structures 7 and one locking structure 3 are provided in the above embodiment, three or more terminal holding structures may be provided and/or two or more locking structures may be provided. Further, a plurality of terminal pairs each composed of a male terminal and a female terminal may be disposed in one terminal holding structure.

In the above embodiment, the male terminals 11 are provided in the device-side connector 10 and the female terminals 21 are disposed in the wire-side connector 20. However, conversely, female terminals may be provided in a device-side connector and male terminals may be provided in a wire-side connector.

Although the device-side connector 10 and the connector structure 1 are attached to the known solenoid D including a hollow cylindrical electromagnetic part and a cylindrical valve part inserted into the electromagnetic part in the above embodiment, the device-side connector and the connector structure of the present technique are not limited to this and can be attached to an arbitrary device having a hollow cylindrical shape or may be integrally formed to an arbitrary device having a hollow cylindrical shape.

LIST OF REFERENCE SIGNS

1: connector structure
3: locking structure
7: terminal holding structure
10: device-side connector (first connector)
11: male terminal
13: first locking portion (locking portion)
17: first terminal holding portion
20: wire-side connector (mating connector, second connector)
21: female terminal
23: second locking portion (locking portion)
27: second terminal holding portion
28: terminal engaging hole
D: solenoid
W: wire

What is claimed is:

1. A connector structure, comprising:

a device-side connector extending in a forward to backward direction and having a cavity including a pair of first terminal holding portions spaced apart in a direction normal to the forward to backward direction, a first locking portion formed in an inner surface of the device-side connector and two ridges projecting into the cavity, the two ridges spaced apart in the direction normal to the forward to backward direction at positions between the pair of first terminal holding portions and extending in the forward to backward direction;

a first pair of terminals accommodated respectively in the pair of first terminal holding portions;

a wire-side connector configured to be accommodated at least partially in the cavity of the device-side connector, the wire-side connector including a pair of second terminal holding portions at positions corresponding to the pair of first terminal holding portions and a groove recessed in an outer surface of the wire-side connector and dimensioned to receive the two ridges of the device-side connector when the device-side and wire-side connector are connected, and a second locking portion formed in the groove at a position corresponding to the first locking structure and configured to engage the first locking structure when the device-side and wire-side connectors are connected; and a second pair of terminals disposed respectively in the second terminal holding portions and connected respectively to the first pair of terminals when the device-side and wire-side connectors are connected.

2. The connector structure of claim 1, wherein the first locking portion is formed of insulating synthetic resin and disposed between the pair of first terminals.

3. The connector structure of claim 1, wherein the pair of first terminals are male terminals formed of metal pieces each having a tongue shape, and plate surfaces thereof are disposed along a radial direction of the device.

* * * * *